US010358338B2

(12) United States Patent
Liu

(10) Patent No.: US 10,358,338 B2
(45) Date of Patent: Jul. 23, 2019

(54) AUTO-BALANCING HOSE SYSTEM AND METHOD FOR FLUID TRANSFER

(71) Applicant: Xuejie Liu, Katy, TX (US)

(72) Inventor: Xuejie Liu, Katy, TX (US)

( * ) Notice: Subject to any disclaimer, the term of this patent is extended or adjusted under 35 U.S.C. 154(b) by 51 days.

(21) Appl. No.: 15/293,159

(22) Filed: Oct. 13, 2016

(65) Prior Publication Data

US 2017/0283243 A1 Oct. 5, 2017

Related U.S. Application Data

(60) Provisional application No. 62/317,533, filed on Apr. 2, 2016.

(51) Int. Cl.

| | |
|---|---|
| ***B67D 9/00*** | (2010.01) |
| ***B63B 27/34*** | (2006.01) |
| ***B65H 57/14*** | (2006.01) |
| ***B65H 75/36*** | (2006.01) |

(52) U.S. Cl.

CPC ..... *B67D 9/00* (2013.01); *B65H 57/14* (2013.01); *B65H 75/366* (2013.01); *B63B 27/34* (2013.01); *B65H 2701/33* (2013.01)

(58) Field of Classification Search

CPC ..... B67D 9/00; B63B 27/34; B65H 75/00; B65H 57/14; B65H 75/366; B65H 2701/33

USPC ..... 141/382, 5

See application file for complete search history.

(56) References Cited

U.S. PATENT DOCUMENTS

| | | | | |
|---|---|---|---|---|
| 2,559,703 A * | 7/1951 | Bergman | F16L 1/032 294/67.1 |
| 2,818,891 A * | 1/1958 | Loeser | B67D 9/02 119/14.18 |
| 2,914,080 A * | 11/1959 | Silveston | B67D 9/02 137/236.1 |
| 3,032,082 A * | 5/1962 | Vilain | B67D 9/02 137/615 |
| 3,199,553 A * | 8/1965 | Garrett | B63B 27/18 137/615 |
| 3,228,421 A * | 1/1966 | Shiery | B67D 9/02 137/355.16 |
| 3,434,491 A | 3/1969 | Horton, III | |
| 3,608,577 A * | 9/1971 | Blanchard | F26B 9/103 137/355.17 |

(Continued)

*Primary Examiner* — Timothy L Maust
*Assistant Examiner* — James R Hakomaki

(57) ABSTRACT

The present invention provides an auto-balancing hose system and a method for fluid transfer between an onshore facility and a floating vessel. The system comprises a transfer pipeline extended from the onshore facility to a loading platform, an upward pipe branch fluidly connected to the transfer pipeline, a hose with a first end fluidly connected to the upward pipe branch and a second end fluidly connected with a ship manifold on the floating vessel, a hose saddle or sheave that elevates the hose near the upward pipe branch and divides the hose into a riser at the first end and a U-tube next to the second end. The method includes elevating the hose near the upward pipe branch with a hose saddle and dividing the hose into a riser at the first end and a suspended U-tube at the second end. The hose is kept in tension, and adapted to accommodate vessel motions as well as relative displacements between the transfer pipeline and loading platform.

20 Claims, 4 Drawing Sheets

(56) References Cited

U.S. PATENT DOCUMENTS

| | | | | |
|---|---|---|---|---|
| 4,221,506 | A * | 9/1980 | Shapunov | B65G 67/606 406/115 |
| 4,989,903 | A * | 2/1991 | McAllister | F16L 3/01 285/114 |
| 5,836,361 | A * | 11/1998 | Koncsek | B67D 7/38 137/615 |
| 6,554,538 | B2 * | 4/2003 | Stockstill | B63B 35/03 405/166 |
| 6,886,611 | B2 | 5/2005 | Dupont et al. | |
| 7,147,021 | B2 | 12/2006 | Dupont et al. | |
| 8,176,938 | B2 | 5/2012 | Queau et al. | |
| 8,915,271 | B2 | 12/2014 | Liu | |
| 9,731,795 | B2 * | 8/2017 | Deletre | B63B 27/24 |
| 2015/0329184 | A1 * | 11/2015 | Deletre | B63B 27/24 248/81 |
| 2016/0362163 | A1 * | 12/2016 | Lane | B63B 27/34 |
| 2017/0096195 | A1 * | 4/2017 | Gelin | B63B 27/24 |

* cited by examiner

AUTO-BALANCING HOSE SYSTEM AND METHOD FOR FLUID TRANSFER

CROSS-REFERENCE TO RELATED APPLICATIONS

This application claims priority of U.S. Provisional Patent Application Ser. No. 62/317,533 filed on Apr. 2, 2016.

U.S. Patent Documents

| | | | |
|---|---|---|---|
| 3,434,491 | March 1969 | Bily | 137/315 |
| 6,886,611 | May 2005 | Dupont et al | 141/279 |
| 7,147,021 | December 2006 | Dupont et al | 141/382 |
| 8,176,938 | May 2012 | Queau et al | 137/615 |
| 8,915,271 | December 2014 | Liu | 141/382 |

STATEMENT REGARDING FEDERALLY SPONSORED RESEARCH OR DEVELOPMENT

Not Applicable

BACKGROUND OF THE INVENTION

1. Field of Invention

The present invention relates generally to transferring fluids between an onshore facility and a floating vessel. Specifically, the present invention provides an auto-balancing hose system that accommodates vessel motions as well as relative displacements between a transfer pipeline and a loading platform.

2. Description of the Related Art

Ships move goods and commodities from shore to shore. In some cases, a vessel is docked near shore and serves as a storage unit or production unit. Fluids need to be transferred between the vessel and a shore-based facility through a transfer pipeline. The pipeline is typically supported above water on a port/jetty/trestle and extended from onshore to a loading platform near a vessel. For cryogenic fluids such as liquefied natural gas (LNG), liquefied petroleum gas (LPG), or any other fluids at a cryogenic temperature, expansion loops or bellows are used at an interval along the transfer pipeline to accommodate thermal expansion and contraction due to temperature changes.

A vessel requires a certain water depth for docking and is subjected to motions caused by waves and currents. A manifold onboard a vessel is typically elevated from several meters to 25 meters depending on a vessel type and size. A flexible connection is required between the end of the pipeline and a manifold onboard the floating vessel. This is typically done by an articulated arm made of hard pipes and swivel joints. This hard arm is anchored at its base on a loading platform, and has a riser and an arm to reach the vessel manifold as disclosed in U.S. Pat. No. 3,434,491 to Bily.

Improvements have been made for hard arms. For example, U.S. Pat. No. 8,176,938 to Queau and Maurel discloses a loading system with a movable supporting frame that allows end displacements of a transfer pipeline. Regardless of these improvements, all the hard arms have the followings in common: rigid pipes and a number of swivel joints, and a heavy supporting structure. In reality, most hard arms are fixed at their base and the transfer pipeline is not allowed to expand and contract at the base of the arms. Some hard arms have suffered damage due to thermal expansion of transfer pipelines and/or ground settlements of loading platforms. In addition, these arms are costly and require maintenance with leakage potential at the swivel joints.

Flexible hoses have been developed and used for fluid transfer. One simple way to handle the hoses is to lay the hoses on a loading platform, and manually make connection with ship manifolds (i.e., vessel manifolds) after a ship is docked. By its flexible nature, the hose adjusts its orientation from a horizontal axis on a loading platform to a vertical axis near a ship hull and back to a horizontal axis on a manifold platform onboard the ship. The hoses on the platform are subjected to wearing or kinks, and are applicable to calm water only. To avoid the above problems, U.S. Pat. No. 6,886,611 to Dupont et al discloses a suspended hose in air with one end tied to the top of a rigid riser and another end tied to a vessel manifold. A rigid riser raises the hang-off point for the hose up on the onshore side so that the entire hose is above the water level. This hose system avoids swivel joints and offers great flexibility. However, similar to the hard arm, the rigid riser is anchored at its base and any pipe expansion/contraction of the transfer pipeline or ground movement at the platform could cause high stress around the riser base.

Other systems use a combination of hose and rigid pipe with swivel joint. One common riser tower design has a rigid riser rotatable at its base with a winch to control its top position. The riser top has a n-shape bend with a downward flange and a hose is hung from the downward flange. By gravity, the other end of the hose rests near the bottom of the tower. To connect with a ship manifold, a crane lifts the low end toward a ship while the riser rotates toward the ship and the entire hose moves close to the ship. Other configurations include an articulated arm that lifts both ends of the hose with a connected end and a mobile end. The connected end is fluidly connected to storage units with rigid pipes and swivel joints. For fluid transfer, the arm delivers the mobile end of the hose to vessel manifolds. U.S. Pat. No. 7,147,021 to Dupont and Paquet discloses a similar system that has a riser attached to a vertical post with a rotatable connection. A boom hangs a hose and delivers the mobile end of the hose to a LNG ship. All the above systems require swivel joints and a tall supporting structure.

U.S. Pat. No. 8,915,271 to Liu discloses a transfer system with a vertical shaft and a hose freely hanging inside the shaft. Since the hose is hung below a transfer pipeline with a downward pipe branch and stored under the water level, there is no need to raise the hang-off point on the onshore side. The system avoids swivel joints and allows the pipeline end to expand and contract freely at the shaft. This system is ideal for a transfer pipeline located underground, for example inside a tunnel. The shaft rises up from the end of the tunnel at the seabed, and provides a dry space under water and protection for hoses and other equipment. However, this vertical shaft involves a different installation method rather than conventional piling and is likely to result in a higher construction cost for the cases where transfer pipelines are supported above the sea level.

Earthquakes, storm surges and soil erosions often trigger permanent ground deformations at a slope ground such as a coastal line or a river delta. The ground movements often overstress pipelines and/or loading systems. Strengthening the slope around a coast or river bank is possible, but results in huge construction costs. None of the systems mentioned above addresses the impact of permanent ground deformations that are likely to cause the movements of loading platforms.

In summary, there is a need to develop a robust and cost-effective loading system for terminals and loading stations where transfer pipelines are located above the sea level and relative displacements between transfer pipelines and loading platforms occur.

BRIEF SUMMARY OF THE INVENTION

The present invention provides an auto-balancing hose system for fluid transfer between an onshore facility and a vessel docked at a loading platform. The system comprises a transfer pipeline extended from the onshore facility to the loading platform and subjected to displacements relative to the loading platform, a hose with a first end fluidly connected to the transfer pipeline and a second end fluidly connected with a ship manifold (i.e., vessel manifold), a hose saddle or sheave that elevates the hose and divides the hose into a riser at the first end and a freely suspended U-tube next to the second end, and a counterweight or a winch with a predetermined pulling force that maintains a top tension to the riser. As a result, the entire hose is in tension. The hose is able to accommodate large ship motions, pipe end displacements and movements of the loading platform. When the loading platform sinks or slides down a slope due to soil consolidation, earthquakes or mudslides, the hose automatically adjusts its position without stressing the hose and the transfer pipeline.

Accordingly, it is a principal object of the invention to provide a loading system that accommodates relative displacements between a transfer pipeline and loading platform.

It is another object of the invention to keep the hose above the sea level and away from ocean waves.

It is another object of the invention to provide a hose system that is applicable for large ship motions (e.g., 5.5 m wave height, and 15 m heave motion).

It is another object of the invention to provide a loading system that is applicable for cryogenic fluids or hot fluids with pipe end displacements at a loading platform.

It is another object of the invention to provide a loading system that accommodates the movements of loading platforms resulted from permanent ground deformations.

It is another object of the invention to provide a loading system in which the hose can be easily inspected and replaced.

It is another object of the invention to provide a loading system with a minimum cost and maintenance.

BRIEF DESCRIPTION OF THE DRAWINGS

The loading system, method and advantages of the present invention will be better understood by referring to the drawings, in which.

DETAILED DESCRIPTION OF THE PREFERRED EMBODIMENT

Figure 1:
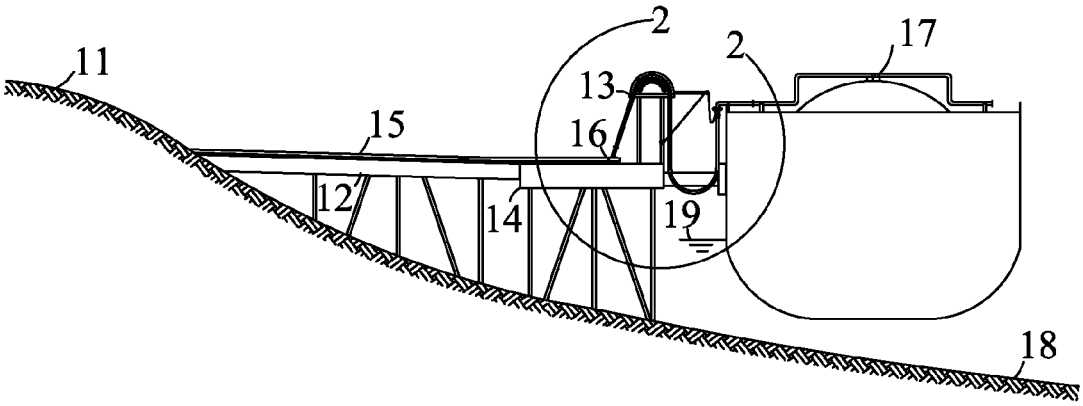
FIG. 1 is an elevation view of a first embodiment of the system with a sea-going vessel at a loading terminal.

FIG. 1 is an overview of a first embodiment of the present invention at a loading terminal. A vessel 17 is docked near a loading platform 14. A trestle 12 extends from a coastal area 11 (i.e., onshore area near the sea) to the loading platform 14, and supports a transfer pipeline 15 above the sea level 19 with a seabed 18 below. The transfer pipeline 15 is fluidly connected to an onshore facility (not shown). This onshore facility can be a storage tank, a temporary/mobile container, a fluid production plant (e.g., liquefied natural gas, chemical, biofuel, etc.), a pipeline network or a fluid consumer (e.g., a factory, a power plant, etc.). A hose saddle 13 is supported on the loading platform 14 and the transfer pipeline 15 ends below the hose saddle 13 with a free end 16. The transfer pipeline 15 is supported on low friction pads such as Teflon or on pipe rollers (not shown). This allows the pipeline to expand or contract axially at the free end 16. It also allows the loading platform to move away from the transfer pipeline, for example when a mudslide occurs. Alternatively, the vessel 17 is docked at an unloading (i.e., receiving) terminal or a bunkering station. Alternatively, a vessel 17 is a sea-going ship. Alternatively, a vessel 17 is a barge.

Figure 2:
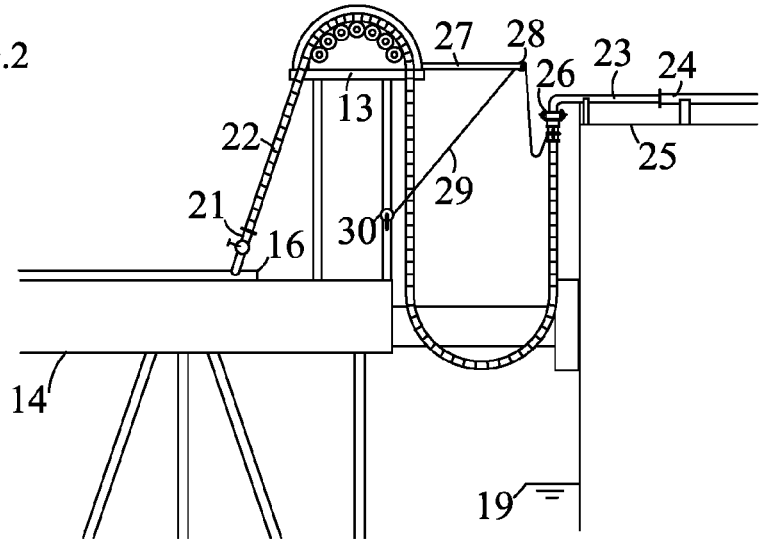
FIG. 2 is a detailed view along 2-2 line of FIG. 1 with a hose being elevated by a hose saddle.

FIG. 2 shows the details along the 2-2 line in FIG. 1. At the free end 16, there is an upward pipe branch 21. This upward pipe branch can have an angle varying from 10 degree to 90 degree up from the horizon with a preferable angle from 60 degree to 90 degree. The first end of a hose 22 is fluidly connected to the upward pipe branch 21 and the second end 26 is fluidly connected to a vessel manifold 24 at a manifold platform 25 of the vessel 17 through a manifold extension 23. The hose saddle 13 elevates the hose 22 above the free end 16 with a majority of hose freely suspended in a U-tube between the hose saddle and the vessel manifold 24. A cantilever beam 27 is anchored at the base of hose saddle 13. A pulley 28, a rope 29 and a winch 30 are used to tie the second end 26 of the hose 22 to the cantilever beam 27 loosely.

The hose saddle 13 is preferably to have a low-friction surface to reduce wearing to the hose surface. One way to achieve low friction is to have a group of roller bars or rollers arranged at a semi-circular shape. Alternatively, low friction-coefficient materials can be used at the surface. These materials include metal with a smooth surface (such as stainless steel), PTFE (polytetrafluoroethyle, such as Teflon), etc.

Figure 3:
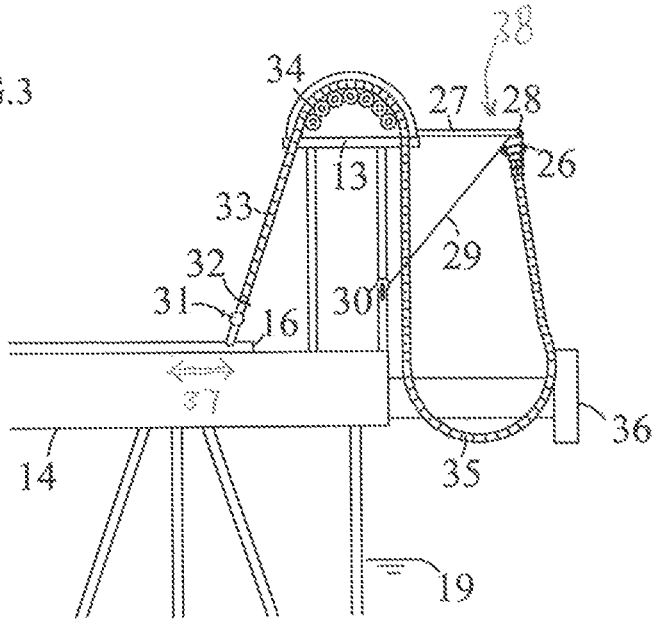
FIG. 3 shows a hose in a storage position with a riser being tensioned by a U-tube.

FIG. 3 shows a storage position of the hose from FIG. 2. Once fluid transfer is over, disconnect the second end 26 of the hose from the manifold extension 23. Turn the winch 30 and drag the second end 26 to the pulley 28 for storage. The second end 26 rests at a hang-off device 38 during idle periods and is held up at an elevation comparable to the hose saddle 13. This hang-off device 38 comprises a cantilever beam 27 and a rope 29 or the like that keeps the U-tube above the sea level. It is preferred that a remotely controlled motor (not show) is attached to the winch. Around the free end 16, a branch valve 31 is located at the upward pipe branch. The hose saddle 13 elevates the hose near the upward pipe branch 21 and divides the hose into three segments: a riser 33 between a first end 32 and the hose saddle 13, a hose-in-contact segment 34 on the hose saddle and a U-tube 35 freely hung between the hose saddle and the second end 26. As a ship manifold is typically elevated higher than the transfer pipeline, the second end 26 is higher than the first end 32 during the fluid transfer and kept higher during non-transfer periods.

In order for the riser 33 to remain in tension, it is required that the lowest point of the U-tube 35 be lower than the first end 32. In another word, the hose segment remained immediately below the hose saddle (i.e., extended from the hose saddle to the lowest point of the U-tube) over-weights the riser 33. When a crane is used to lift the second end 26 of the hose, care must be taken to keep the lowest point of the U-tube lower than the first end 32 in order to keep the entire hose in tension. A fender 36 is for protecting a vessel and keeping a distance between the loading platform 14 and a vessel.

Figure 4:
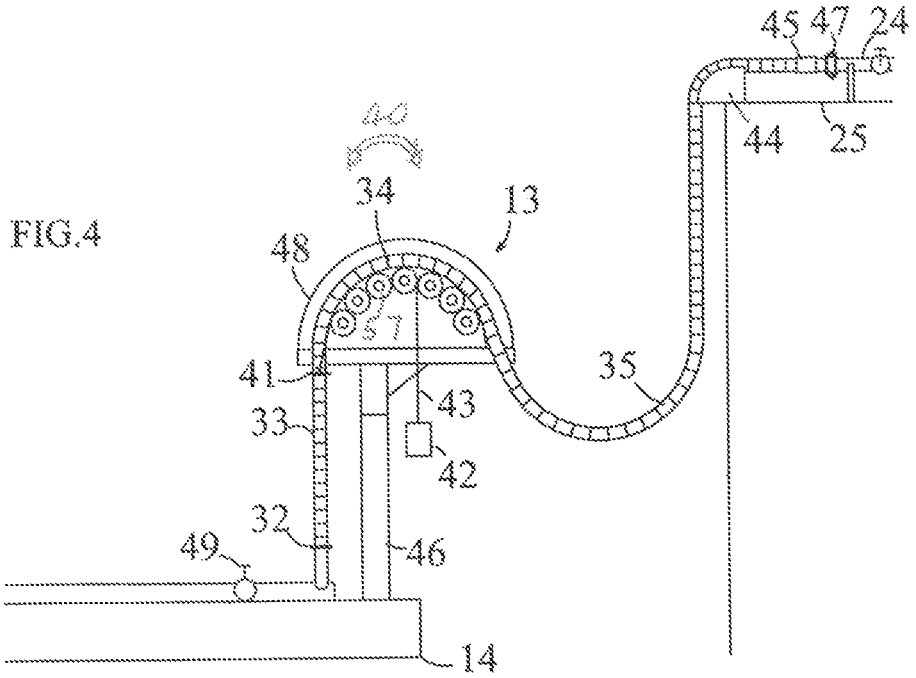
FIG. 4 shows a riser with top tension from a counterweight.

FIG. 4 shows another mechanism to keep the riser 33 in tension. A middle flange 41 is located at the top of riser 33. A counterweight 42 is hung below the hose saddle 13 with two cables 43 tied at the low end. The cables 43 pass through a top surface area of the hose saddle (e.g., some rollers) with the top end tied to the middle flange 41 (preferably 180 degree apart). In another word, the gravity force of the counterweight 42 is redirected to the top tension and applied on the middle flange 41 of the riser 33. It is preferred that the gravity force of the counterweight 42 is more than the gravity force of the riser 33. The counterweight 42 can be a block made of dense material such as concrete and metal, or a container that holds dense materials. Alternatively, the top tension is from a pulling cable controlled by a winch.

In this figure, the hose saddle 13 (redirecting hose up to 180 degree) is supported by a column 46. It is preferred that the hose saddle 13 is rotatable along the column 46 when the vessel drifts forward or backward under water currents/waves. A half saddle 44 (redirecting hose up to 90 degree) is located at the edge of a manifold platform 25 and supports the U-tube 35 near the second end. This half saddle 44 is preferably to have a smooth surface and guides at the both sides to prevent the hose from falling off. There is a breakaway coupler 45 at the second end of the hose. There is also a quick connecting/disconnecting coupler 47 for quick connection with the vessel manifold 24. In order to keep the hose from falling off the hose saddle 13, two semi-guides 48 are preferably to have a height at twice the hose size. A control valve 49 is located on the transfer pipeline near the free end 16. When a pipe-in-pipe configuration is used for the transfer pipeline, the inner pipe has a short exposed section that ties-in to this control valve 49. Alternatively, another hose saddle is located near the first end and adjusts hose direction there when needed.

As shown in both FIG. 3 and FIG. 4, the freely hanging U-tube is the source of flexibility that allows the hose to accommodate ship motions as well as relative displacements between the transfer pipeline and loading platform. The relative displacements include translational and rotational movements in any direction. The more hose length in the U-tube, the more distance the first end and second end can travel. For example, when the free end 16 displaces away from the vessel due to thermal contraction or toward the vessel due to thermal expansion (i.e., pipe displacements 37 of the transfer pipeline relative to the loading platform 14 in FIG. 3), the U-tube 35 will feed more or less hose segment into the riser 33 automatically. When the loading platform tilts towards the vessel due to ground movements in an earthquake prone as an example, the hose-in-contact segment 34 will travel over a plurality of rollers 57 of the hose saddle 13 automatically. In addition, when the hose saddle is elevated up or down (e.g., on a floating platform), the riser adjusts its length accordingly and automatically. Alternatively a hose will slide over a smooth surface of a hose saddle when subjected to loading platform movements relative to the seabed 18 (refer to FIG. 1). In either case, the hose is free to move axially (i.e., in a direction 40 shown in FIG. 4) along said hose saddle and configured to accommodate both translational and rotational movements of hose saddle relative to the seabed as well as the pipe displacements relative to the loading platform. When the vessel moves, the U-tube 35 will adjust its position and allow the second end of the hose to follow. Despite the movements, the hose remains in tension at all times.

Figure 5:
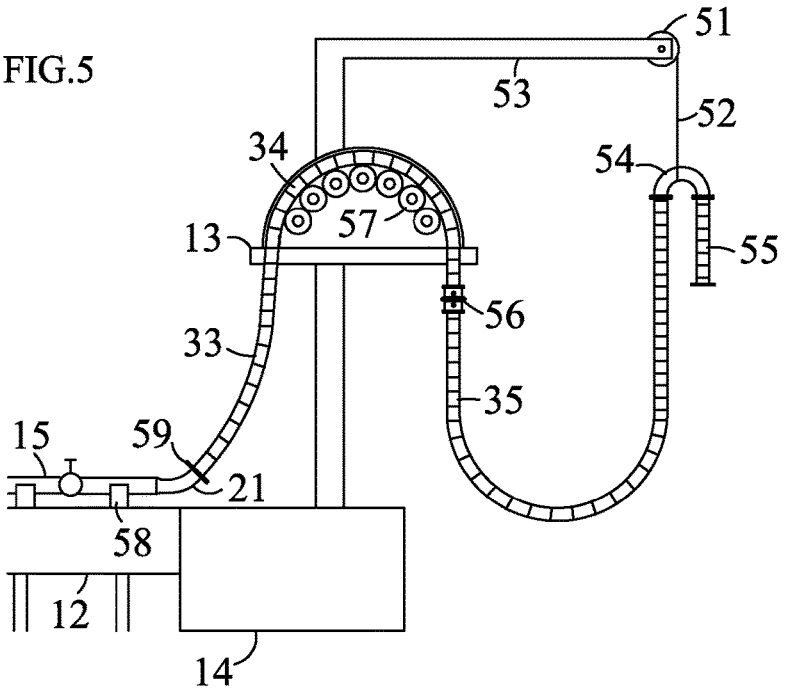
FIG. 5 is a variation of FIG. 3 with an ERC being contributed to tension in a riser.

FIG. 5 shows a variation to FIG. 3 with additional riser tension from a flow control device. A winch 51 is attached to a cantilever beam 53 and a rope 52 ties a rigid coupler 54 to the winch 51. The rigid coupler 54 has two downward flanges that are fluidly connected to the second end of the hose and a hose extension 55. In another word, the rigid coupler 54 fluidly connects hose extension 55 to the second end of hose and lifts them up in the air. Alternatively, the cantilever beam 53 is the boom of a crane. An emergency release coupler (ERC) 56 is hung below the hose saddle 13. The weight of ERC 56 increases tension in the riser 33 through the hose-in-contact segment 34 supported on a plurality of rollers 57. At a loading platform 14 offshore, a transfer pipeline 15 is supported on a trestle 12 with pipe saddles 58. An upward pipe branch 21 is fluidly connected to the transfer pipeline 15 at one end and has an upward flange 59 facing the hose saddle. The riser 33 is tied-in to the pipe branch 21 at the first end of the hose with a preferred flange connection. In this case, the upward pipe branch has an elbow that makes direction transition from a horizontal orientation to an upward direction. At a lower upward angle (e.g., 45 degree or less), the riser 33 deflects from an orientation in alignment with the upward flange 59 to a vertical orientation near the hose saddle by its flexible nature.

Figure 6:
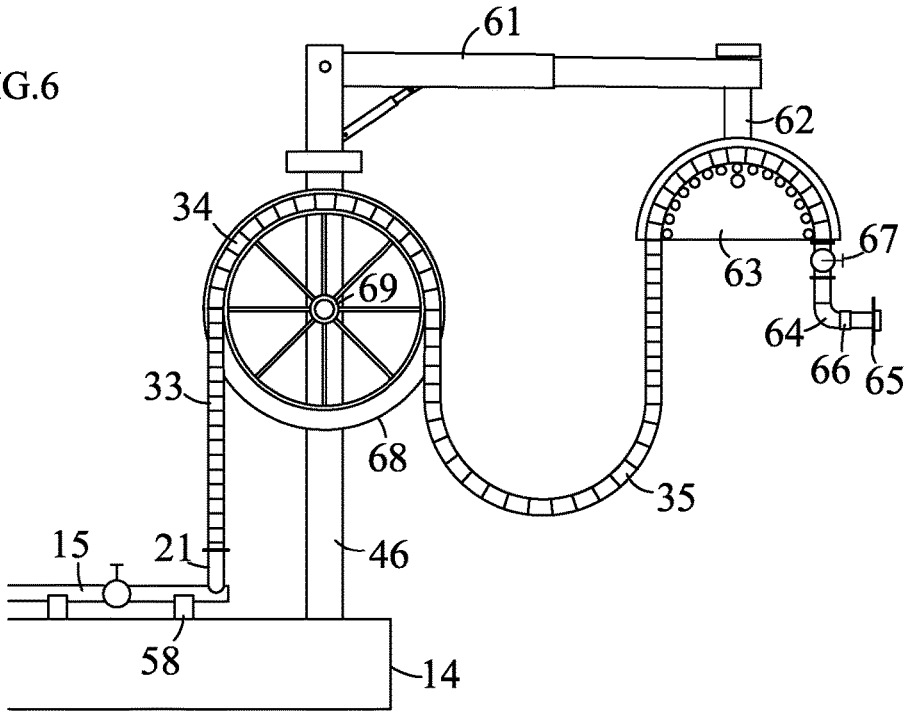
FIG. 6 is a variation to FIG. 3 in which a hose is elevated with a sheave and a mobile end is lifted with a crane.

FIG. 6 shows a variation to FIG. 3 with a hose in a storage position. A crane 61 lifts a mobile saddle 63 with a vertical bar 62. The crane is supported on a loading platform 14 and can rotate at a column 46. It is preferred that both the mobile saddle 63 and the vertical bar 62 are rotatable for max flexibility. The hose is supported on the mobile saddle 63 near the second end. At the second end of the hose, there are an end valve 67, an elbow 64, a swivel joint 66 and a dry connector 65. When a ship is docked, the crane 61 delivers the second end toward the vessel manifold, and the dry connector 65 can be dragged towards the manifold for connection. Optionally, two cables can be used to lift the end valve 67 and end fittings with a balancing weight (not shown, similar to the mechanism of counterweight 42 and cable 43 in FIG. 4) or with a remotely controlling winch (not shown, similar to a winch 51 in FIG. 5). This balancing weight or winch allows the dry connector to move along with a vessel manifold easily.

Alternatively, the mobile saddle 63 is replaced with a sheave. Alternatively, the elbow 64 is oriented perpendicular to the hose-hanging plane, and has a swivel joint (not shown). When not in use, the dry connector 65 is facing downward. After connecting with a ship manifold, the swivel joint allows the elbow 64 to adjust its orientation automatically during ship motions.

At the loading platform 14, an upward pipe branch 21 is fluidly connected to a transfer pipeline 15 and has an upward flange tied-in to the riser 33. A sheave 68 is supported on a column 46 and elevates the hose. A motor 69 drives the sheave 68 at its axle and applies riser top tension (i.e., a predetermined holding power) through the hose-in-contact segment 34. When the transfer pipeline 15 contracts (for example), the tension in the riser tends to increase. When the riser tension exceeds the holding power, the riser starts to move along the transfer pipeline until the tension is re-balanced with the holding power. Alternatively, a counter-weight 42 is hung from the sheave 68 on the U-tube side and adapted to keep the riser 33 in tension.

Figure 7:
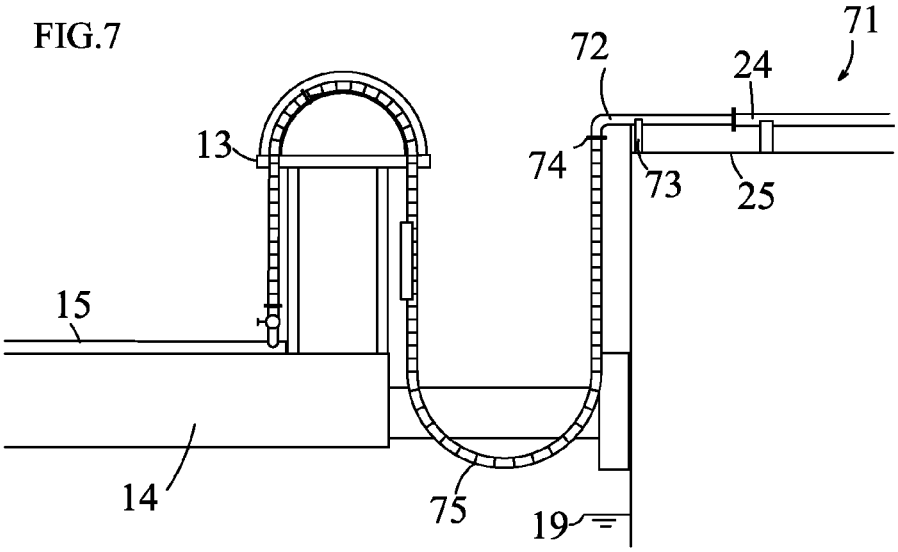
FIG. 7 is a second embodiment of this system for fluid transfer between an onshore pipeline and a stationary vessel.

FIG. 7 shows a second embodiment of this system. A floating storage vessel 71 is docked near a loading platform 14. A transfer pipeline 15 is elevated above the sea level 19, and preferably inclined with a high end at a coastal area 11 (refer to FIG. 1) and a low end at the loading platform 14. For cryogenic fluids or hot fluids, an insulation layer along with an external water barrier layer is required for the transfer pipeline 15. Alternatively, a transfer line can use a pipe-in-pipe configuration with insulation in the annulus.

Similarly, a hose 75 has a first end fluidly connected to the transfer pipeline 15 and a second end fluidly connected to a vessel manifold 24. Around a manifold platform 25, a manifold extension 72 extends from the vessel manifold 24, passes through a vertical support 73 and ends with a down-ward flange 74. The hose 75 is fluidly connected with the downward flange 74 at the second end. Alternatively, the second end of the hose 75 is directly connected to the vessel manifold 24 with the assistance of a half saddle on the manifold platform 25 (as shown in FIG. 4).

Figure 8:
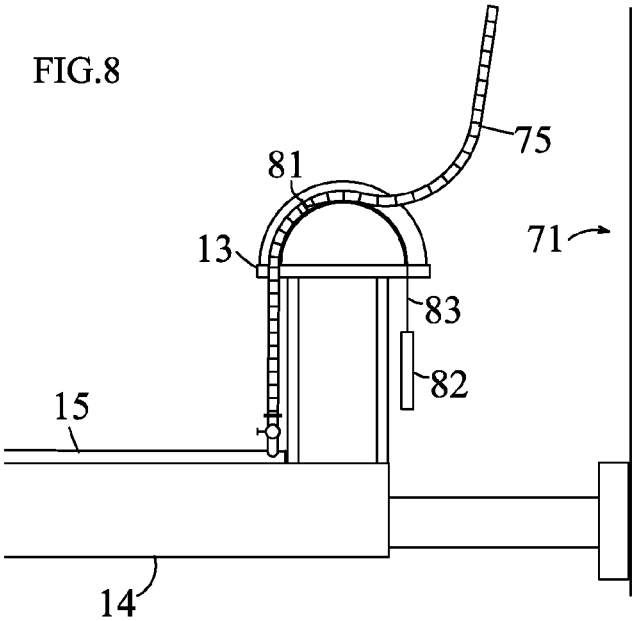
FIG. 8 is a changed position of FIG. 7 in which the hose reaches its maximum height.

This hose configuration shown in FIG. 7 has a riser at the first end and a U-tube at the second end separated by a hose saddle. It is extreme flexible and its flexibility comes from the hose length stored in the U-tube. Take the heave motion of the vessel 71 as an example, a minimum elevation of the second end of the hose can be determined when the bottom of the U-tube touches the sea level. On the other hand, the maximum elevation of the second end can be determined when the U-tube becomes a J-tube as shown in FIG. 8. The maximum and minimum elevations form the envelope for the heave motion of the vessel 71. This hose configuration can achieve a large heave motion and reach a vessel mani-fold at up to three times the height of the hose saddle. It reduces the cost for building a tall supporting structure that is often needed in other systems as mentioned in the prior art.

Similarly, a counterweight 82 is attached to a middle flange 81 with two cables 83 and hung below the hose saddle 13. The counterweight 82 is made of a flexible tube filled with sand or other granular materials. The counterweight 82 helps reduce the height of the hose saddle and/or the length of the hose. In order for the second end of the hose 75 to reach the maximum elevation shown in FIG. 8, the coun-terweight 82 needs to be heavier than the hose segment extended from the first end to the middle flange 81. This hose configuration in FIG. 8 can also be used for draining liquids out of the hose when needed.

Alternatively, a vessel 71 is a production vessel. Alterna-tively, the hose 75 is a hose-in-hose with an inner hose and outer hose. The middle flange 81 is on the outer hose while the inner hose is continuous (not shown). With suitable materials, the hose 75 is used for transferring cryogenic fluids or hot fluids.

The method for establishing an auto-balancing hose load-ing system between a transfer pipeline having an upward pipe branch and a floating vessel with a vessel manifold essentially includes one step: 1) elevating a hose near the upward pipe branch and dividing the hose into a riser at a first end and a U-tube at a second end. With the first end fluidly connected to the transfer pipeline at the upward pipe branch and the second end fluidly connected to a vessel manifold, the entire hose is kept above the sea level. As a result, the hose is kept in tension and adapted to balance its positions automatically when subjected to ship motions, pipe end displacements and/or platform movements.

I claim:

1. A loading system for transferring fluids between an onshore facility and a vessel (17), said vessel (17) is docked above a seabed (18) with a vessel manifold (24) near a loading platform (14), said loading system comprising:

a) a transfer pipeline (15) extended from said onshore facility to said loading platform (14), said transfer pipeline (15) is subjected to pipe displacements (37) relative to said loading platform (14);

b) an upward pipe branch (21), said upward pipe branch (21) is fluidly connected to said transfer pipeline (15) at said loading platform (14);

c) a hose (22) with a first end (32) and a second end (26), said first end (32) is fluidly connected with said upward pipe branch (21), and said second end (26) is fluidly connected with said vessel manifold (24);

d) a hose saddle (13), said hose saddle (13) elevates said hose (22) near said upward pipe branch (21) and divides said hose (22) into a riser (33) at said first end (32) and a suspended U-tube (35) next to said second end (26), said hose is free to move axially along said hose saddle (13);

wherein said hose (22) is kept away from water and in tension, and configured to accommodate said pipe displacements (37) relative to said loading platform automatically.

2. The loading system of claim 1 further comprising an emergency release coupler (56), said emergency release coupler (56) is hung from said hose saddle (13) and con-figured to apply top tension to said riser (33).

3. The loading system of claim 1 further comprising a counterweight (42, 82), said counterweight (42, 82) is con-figured to apply top tension to said riser (33).

4. The loading system of claim 1 further comprising a motor (69), said motor (69) is configured to apply top tension to said riser (33).

5. The loading system of claim 1 further comprising a hang-off device (38), said hang-off device (38) holds up said second end and keeps said hose (13) above a sea level (19) during non-transfer periods.

6. The loading system of claim 1 further comprising a crane (61), said crane is configured to lift and deliver said second end (26).

7. The loading system of claim 6 further comprising a mobile saddle (63), said crane (61) lifts said mobile saddle (63) and said mobile saddle (63) supports said hose (22) near said second end (26).

8. The loading system of claim 6 further comprising a rigid coupler (54) and a hose extension (55), said rigid coupler (54) fluidly connects said hose extension (55) to said second end (26) and is lifted by said crane (61).

9. The loading system of claim 1, wherein said hose (22) further comprises a middle flange (41, 81).

10. The loading system of claim 1, wherein hose saddle (13) is supported on said loading platform (14), and said hose (22) is configured to allow said hose saddle (13) to be elevated up and down.

11. The loading system of claim 1, wherein said loading platform (14) is subjected to translational and rotational movements relative to said seabed (18), and said hose (22) is configured to accommodate said movements.

12. The loading system of claim 1, wherein said hose saddle (13) further comprising a plurality of rollers (57), said plurality of rollers (57) reduce wearing to said hose (22).

13. The loading system of claim 1 further comprises an elbow (64) and a swivel joint (66) that are fluidly connected to an end of said hose (22).

14. The loading system of claim 1, wherein said fluids are at a cryogenic temperature and result in said pipe displacements (37) relative to said loading platform (14) due to thermal expansion and contraction.

15. The loading system of claim 1, wherein said vessel (17) is selected from the group consisting of a floating storage unit, a floating production unit, a barge and a ship.

16. A loading system for transferring fluids between an onshore facility and a vessel (17), said vessel (17) is docked with a vessel manifold (24) near a loading platform (14), said loading system comprising:

a) a transfer pipeline (15) extended from said onshore facility to said loading platform (14), said transfer pipeline (15) is subjected to pipe displacements (37) relative to said loading platform (14);

b) an upward pipe branch (21), said upward pipe branch (21) is fluidly connected to said transfer pipeline (15) at said loading platform (14);

c) a hose (22) with a first end (32) and a second end (26), said first end 02) is fluidly connected with said upward pipe branch (21), and said second end (26) is fluidly connected with said vessel manifold (24);

d) a sheave (68), said sheave (68) elevates said hose (22) near said upward pipe branch (21) and divides said hose (22) into a riser (33) at said first end (32) and a suspended U-tube (35) next to said second end (26), said hose is free to move axially along said sheave (68);

wherein said hose (22) is kept in tension, and configured to accommodate said pipe displacements (37) automatically.

17. A method for transferring fluids with a hose (22) between a transfer pipeline (15) and a vessel (17), said transfer pipeline (15) is fluidly connected with an upward pipe branch (21) at a loading platform (14) and subjected to pipe displacements (37) relative to said loading platform (14), said vessel (17) is docked with a vessel manifold (24) near said loading platform (14), said hose has a first end (32) fluidly connected to said upward pipe branch (21) and a second end (26) fluidly connected to said vessel manifold (24), said method comprising:

a) elevating said hose near said upward pipe branch (21) with a hose saddle (13) and dividing said hose (22) into a riser (33) at said first end (32) and a suspended U-tube (35) next to said second end (26), said hose is free to move axially along said hose saddle (13);

wherein said hose (22) is kept in tension, and configured to accommodate said pipe displacements (37) automatically.

18. The method of claim 17, further comprising applying top tension to said riser (33) with a motor (69).

19. The method of claim 17, further comprising applying top tension to said riser (33) with a counterweight (42, 82) through force redirection.

20. The method of claim 17 further comprising keeping the bottom of said U-tube (35) below said first end (32) when lifting said second end (26) with a crane (61).

* * * * *